United States Patent [19]

Soehnlein et al.

[11] Patent Number: 4,941,339

[45] Date of Patent: Jul. 17, 1990

[54] TOOL BITS AND METHOD OF SHAPING

[75] Inventors: Dieter Soehnlein, Kaufering; Dieter Wirths; Anton Knoller, both of Landsberg am Lech; Peter Kunert, Kaufering, all of Fed. Rep. of Germany

[73] Assignee: Hilti Aktiengesellschaft, Fürstentum, Liechtenstein

[21] Appl. No.: 355,566

[22] Filed: May 23, 1989

[30] Foreign Application Priority Data

May 25, 1988 [DE] Fed. Rep. of Germany ..... 3817680

[51] Int. Cl.[5] ..... B21K 5/10

[52] U.S. Cl. ..... 72/189; 72/406

[58] Field of Search ..... 72/189, 406, 412, 476; 76/108

[56] References Cited

U.S. PATENT DOCUMENTS

| | | | |
|---|---|---|---|
| 685,417 | 10/1901 | Williams | 72/189 |
| 1,231,324 | 6/1917 | Arthur | 72/476 |
| 4,840,519 | 6/1989 | Kleine | 408/226 |

*Primary Examiner*—Lowell A. Larson

*Attorney, Agent, or Firm*—Toren, McGeady & Associates

[57] ABSTRACT

Grooves are formed in an insertion end of a working tool, such as a tool bit or a chisel bit by pivoting a grooving tool about a pivot axis extending perpendicularly to the axis of the insertion end. By pivoting the grooving tool about the pivot axis, it moves along the axial direction of the insertion end forming the grooves. A plurality of the grooving tools can be ganged together and moved by a single drive unit for simultaneously forming angularly spaced grooves in the insertion end.

6 Claims, 3 Drawing Sheets

TOOL BITS AND METHOD OF SHAPING

BACKGROUND OF THE INVENTION

The invention is directed to a method of shaping grooves in a surface, particularly for shaping grooves in the insertion end of a working tool, such as a drill bit or a chisel bit.

Tool bits fabricated by a shaping method of the above-mentioned type are disclosed in DE-PS 2 551 125 and such tool bits are used particularly for working in rock formations. The tool bits are inserted into a chuck or tool holder of a drive unit and the chuck has fixed locking elements or radially displaceable elements for engaging in a positive locking manner into grooves in the insertion end of the tool bit. Such locking elements transmit torque to the tool bit and, in addition, prevent the tool bit from being displaced out of the drive unit chuck. The grooves mentioned above, formed in the insertion end of a tool bit for affording positive locking engagement of the tool bit in a chuck, or tool holder, can be fabricated in a variety of ways. For instance, it is known to form such grooves by a machining operation. Machining has the known disadvantages of high time expenditure and unfavorable effects upon the material of the tool bit by interruption of the fibre flow. The known stamping process disclosed in DE-OS 3 015 893 has not been able to eliminate completely the disadvantages involved in high time expenditures. Moreover, relatively large working tools are needed because of the high forces required in the stamping process.

SUMMARY OF THE INVENTION

Therefore, a primary object of the present invention is to provide a method for the simple and effective formation of grooves in the insertion end of tool bits. Another object is the formation of grooves in tool bits so that the insertion end is not elongated.

In accordance with the present invention, grooves are rolled into the insertion end of the tool bit by means of segment shaped grooving tools which roll over the surface of the insertion end in the axial direction.

In accordance with the present invention, the grooves are formed continuously during rolling of the grooving tools, which require low shaping forces and permit the material in the insertion end to flow more easily. The flow of the material results in a favorable fiber orientation of the materials in the region of the insertion end. In the grooving operation, the grooving tool can be moved from the free end or from the opposite end of the insertion end of the tool bit. In other words, it is possible to roll the grooves directly into the solid material of the insertion end.

Preferably, the grooves are formed or rolled for their entire depth in one pass. Rolling the grooves for their entire depth is possible due to the continuous shaping of the material and the lower force requirement as compared to a pure stamping process. Rolling the grooves in one pass affords an effective groove formation and a high surface quality in the region of the grooves. The grooves can extend in the axial direction or in the circumferential direction of the insertion end.

In a preferred operation, a number of grooves are rolled simultaneously in the insertion end. By simultaneously rolling several symmetrically arranged grooves, the side forces developed during the rolling step can be compensated. If all of the grooves in the insertion end are rolled simultaneously, subsequent cross-sectional changes of previously formed grooves can be avoided. In accordance with this method, there is no limitation on the arrangement or pattern of the grooves. Accordingly, the grooves can be provided diametrically opposite one another or three symmetrically or equiangularly distributed grooves can be formed. In place of individually axially extending grooves, complete groups of grooves extending axially in tandem can be rolled into the insertion end.

It has been noted that a change in length of the insertion end occurs if a number of grooves are arranged around the circumference. Such a change in length is particularly noticeable where at least three grooves are formed and, as a consequence, the cross-section of the insertion end is reduced particularly at the transitions to the grooves. This reduction is disadvantageous to the extent that the essentially radially extending surface of the grooves required for transmitting torque is reduced, whereby the remaining wall portions of the grooves are subjected to overload with premature wear taking place at the insertion end as well as in the locking elements in the chuck. On the assumption that such a disadvantageous cross-sectional reduction can be avoided only by eliminating the length change, it is proposed as an additional feature of the invention to profile the base of the groove as rolled, forming stop faces acting essentially in the axial direction in at least a portion of the grooves. The stop faces formed in profiling the groove base creates a momentary positive lock between the rolling tool and the insertion end as the method is carried out, so that a flow of the material in the rolling direction is blocked by the orientation of the stop faces effective in the axial direction, that is, extending transversely of the axial direction. As a result, material is constrained to flow in the radial direction in the case of considerable shaping deformation resulting from the arrangement of a plurality of grooves, whereby no cross-sectional reduction occurs even in the region of the transitions to the grooves. Instead of profiling the base of the grooves, the insertion end can be clamped by axial abutments for limiting any extension in the axial direction while the grooves are being rolled.

Apparatus for carrying out the method is advantageously distinguished by arranging the grooving tools to pivot about an axis extending essentially perpendicularly to the axial direction of the insertion end. As a result, when the grooving tools are pivoted about the axis essentially perpendicular to the axial direction of the insertion end, the tools roll in the axial direction along the surface of the insertion end. The relative movement between the working tools and the insertion end can be achieved by axial displacement of the pivot axes of the working tools or by a feeding motion of the insertion end.

Preferably, the grooving tools are formed as part of a lever pivotally displaceable around an axis extending basically perpendicularly to the direction of the axis of the insertion end. The working tools can be detachably connected to the lever so that they are easily replaceable. It is preferable for the lever to be formed as a two-arm member with an actuation arm extending away from the arm incorporating the working tool Advantageously, a power cylinder is arranged for pivoting the levers. The power cylinder can be powered by compressed air or preferably by hydraulic liquid. Since comparatively high forces with relatively short travel are required, hydraulically operated cylinders are especially suitable as power cylinders and afford the possibility of effective synchronization of several cylinders operated simultaneously.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE INVENTION

Figure 1:
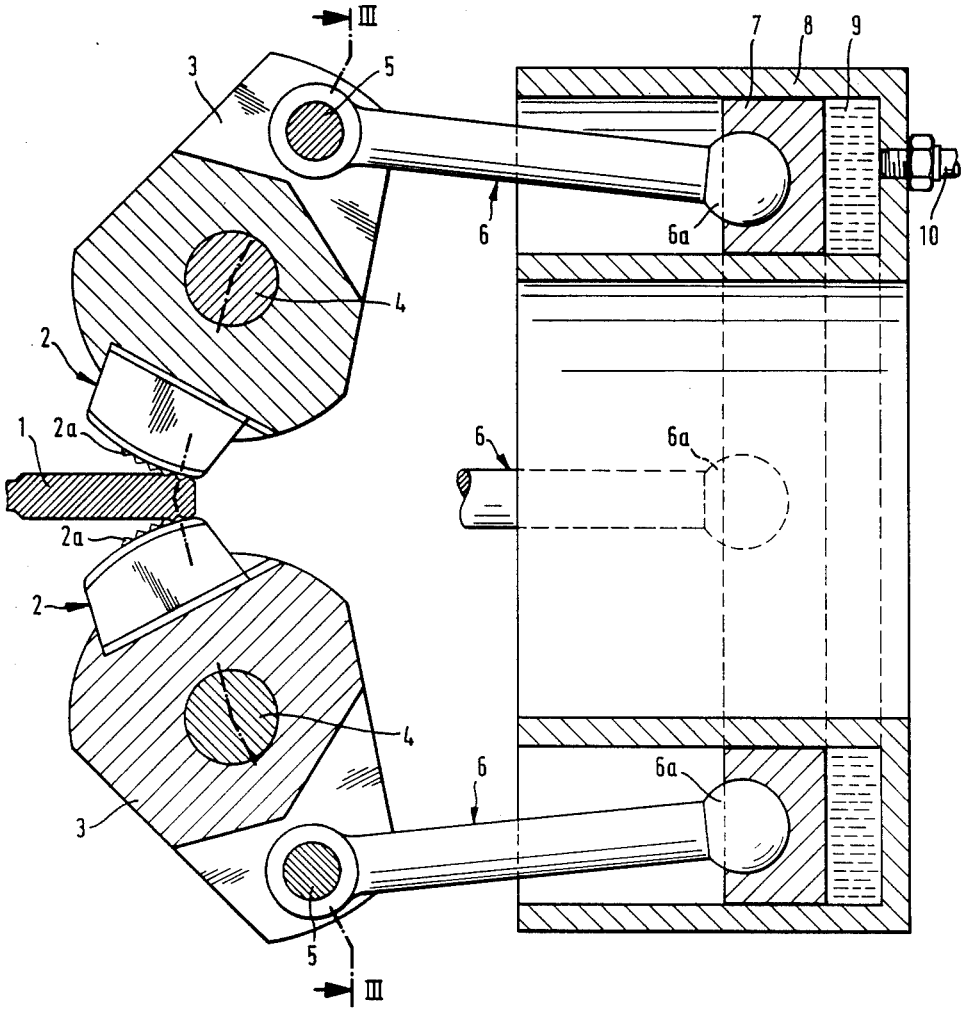
FIG. 1 is a somewhat schematic illustration, partly in section, of apparatus for carrying out the method in accordance with the present invention, shown at the commencement of the rolling step.
Figure 2:
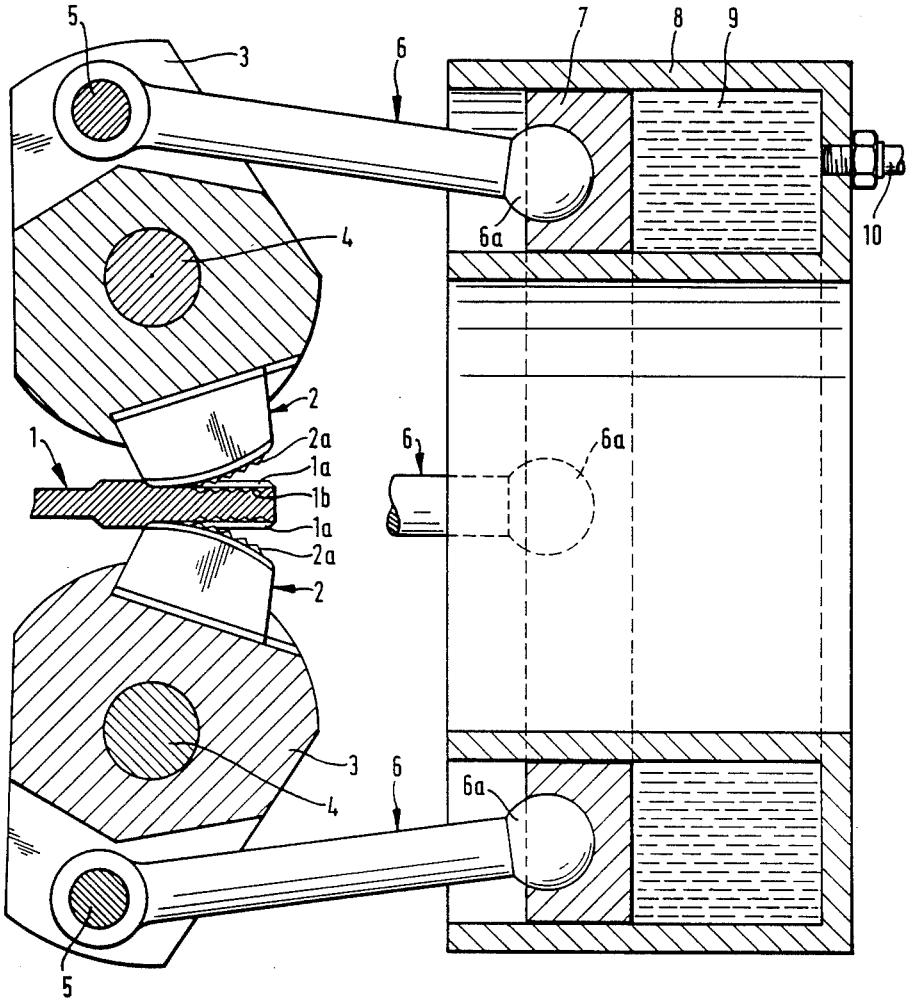
FIG. 2 is a view similar to FIG. 1 however, illustrating the apparatus at the end of the rolling step.

Apparatus for forming grooves in an insertion end 1 of a tool bit, such as a drill bit or a chisel bit, for use in a drive unit, is displayed in FIGS. 1–4 and is made up of individual segment-like grooving tools 2 set in one end of a lever 3. Insertion end 1 is shown extending outwardly from the working tools 2 in its axial direction. Levers 3 are supported about a pivot axis or shaft 4 extending essentially perpendicularly to the axial direction of the insertion end 1. Levers 3 are formed by two arms, one extending from the pivot axis 4, to the grooving tool 2, and the other extending in the opposite direction. The other arm is connected to a push-pull rod 6 by a pin 5 extending through the lever. The push-pull rod at its opposite end from the pin 5, is connected to an annular piston 7, by a ball head 6*a*, seated in the piston. Piston 7 is displaceable in a power cylinder 8 in the axial direction of the insertion end. The annular piston 7 is displaced by a hydraulic fluid 9 charged into the power cylinder 8 through a connecting stub 10. In the starting position, shown in FIG. 1, the insertion end is fed in between the surfaces of the working tools 2. Due to the symmetrical arrangement of the working tools 2, the insertion end is effectively centered. By displacing the annular piston 7 into the end position shown in FIG. 2, by introducing the hydraulic fluid 9 into the cylinder 8, the levers 3 are pivoted about the axis 4 and the grooving tools 2 roll in the axial direction along the insertion end 1 forming the grooves 1*a* in the surface of the insertion end 1. The rolling action of the grooving tools 2 is achieved by rotating the levers 3 about the axes 4, through the push-pull rod 6 moved by the annular piston 7. After completing the rolling of the grooves, the insertion end 1 is released and the levers 3 can be rotated back into the starting position shown in FIG. 1 by means of the annular piston 7. As a result, the apparatus is again ready for rolling grooves 1*a* in another insertion end 1.

Figure 3:
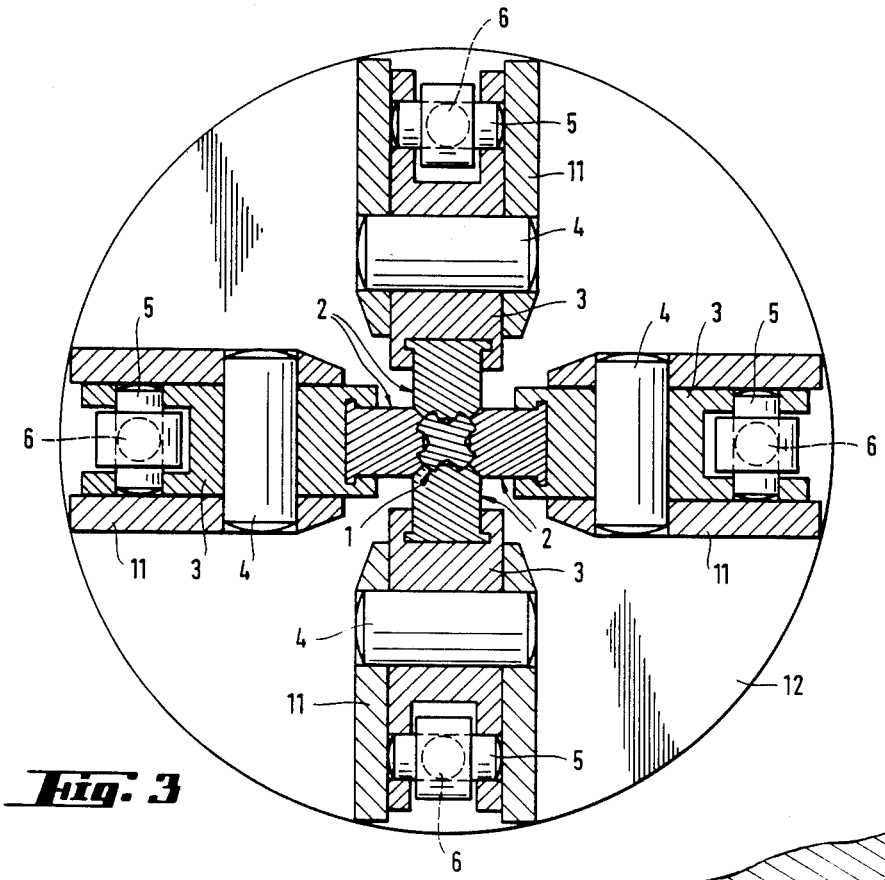
FIG. 3 is a sectional view through the apparatus displayed in FIG. 1 and taken along the line III—III.

In FIG. 3, four levers 3, each supporting a grooving tool 2, are arranged in an equiangularly spaced manner around the circumference of the insertion end 1. Levers 3 are connected with consoles 11 by means of the pivot shafts or axes 4. The consoles 11 are fastened on a face plate 12 not shown in FIGS. 1 and 2. In place of four consoles 11, it is also possible to arrange two, three or six consoles 11 on the face plate 12. As displayed in FIG. 3, the insertion end 1, is contacted by the grooving tools 2, around its entire circumference. This arrangement assures an accurately shaped cross-section of the insertion end 1 during the step of rolling the grooves 1*a*.

Figure 4:
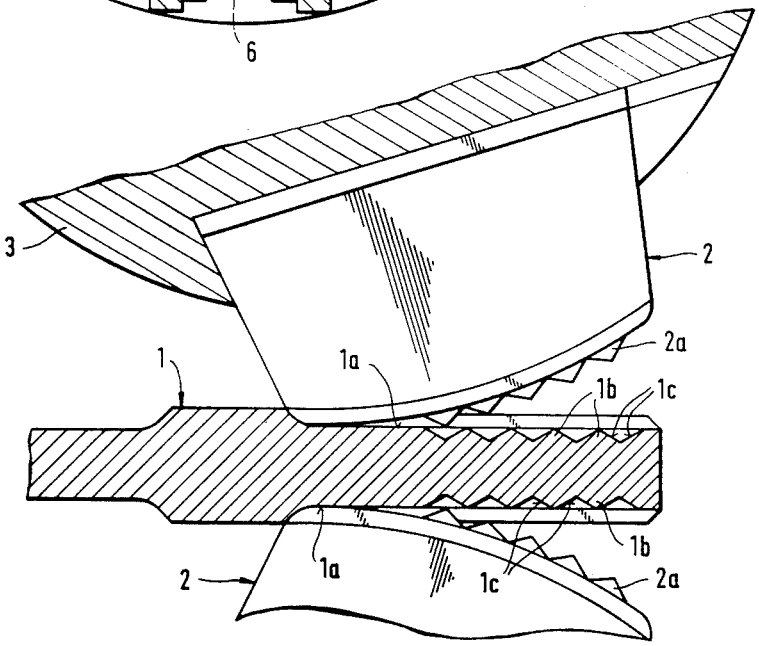
FIG. 4 is a portion of the apparatus illustrated in FIG. 2 and shown on a greatly enlarged scale.

As set forth on a greatly enlarged scale in FIG. 4, the grooves 1*a* are provided with a shaped configuration or profile 1*b*, at the groove base. The shape configuration 1*b*, is made up of abutment or stop faces 1*c*, extending transversely of the axial direction of the insertion end so that they are effective in the axial direction. The shaped configuration 1*b* is rolled into the surface of the insertion end 1, simultaneously with the formation of the grooves 1*a*, by the grooving tools 2, mounted on the levers 3. The surface of the grooving tools 2 for profiling or shaping the base of the groove is effected by a similarly shaped surface 2*a* on the grooving tool which matches the shape formed in the base of the groove. The shaped configuration 1*b* prevents an excessive length change in the insertion end while the grooves la are rolled and enables the formation of an angular profile in the base of the groove in the insertion end. Accordingly, a cross-sectional change, as a result of a length change in the insertion end, is avoided.

While specific embodiments of the invention have been shown and described in detail to illustrate the application of the inventive principles, it will be understood that the invention may be embodied otherwise without departing from such principles.

We claim:

1. A method of shaping grooves in an axially extending insertion end of a tool having an outside surface, such as a drill bit or a chisel bit, the insertion end to be inserted into a drive unit and having a free end surface, comprising the steps of forming the grooves inwardly of the outside surface by moving a grooving tool, relative to the insertion end, in contact with and in the axial direction of the insertion end with the groove having a base spaced inwardly of the outside surface, rolling a plurality of spaced grooves simultaneously, and in the step of forming the grooves, shaping the base of the grooves and forming stop faces extending transversely of the axial direction of the insertion end and being effective as stop faces in the axial direction of the insertion end with adjoining stop faces extending angularly relative to one another and to the axis of the insertion end.

2. Method, as set forth in claim 1, wherein forming the entire depth of the groove in a single pass.

3. Method of shaping grooves in an axially extending insertion end of a tool having an outside surface, such as a tool bit or chisel bit, the insertion end to be inserted into a drive unit and having a free end surface, comprising the steps of placing a grooving tool in contact with the surface of the insertion end, pivoting the grooving tool about an axis extending transversely of the axis of the insertion end and applying force to the grooving tool for moving the grooving tool along the axis of the insertion end and into the outside surface for forming a groove having a base, forming a plurality of spaced grooves simultaneously, and shaping the base of the grooves during the forming step for shaping stop faces extending transversely of the axial direction and being effective as stop faces in the axial direction of the insertion end with adjoining stop faces extending angularly relative to one another and to the axis of the insertion end.

4. Method, as set forth in claim 3, wherein forming the entire depth of the groove in a single pass.

5. Apparatus for forming grooves in an axially extending insertion end of a working tool such as a drill bit or a chisel bit, the insertion end to be inserted into a drive unit, comprising a grooving tool having a segment shaped groove forming surface, a pivot axis in said grooving tool spaced from said groove forming surface and extending transversely of the axis of the insertion end, means for pivoting said grooving tool around the pivot axis and thereby moving the groove forming surface in the axial direction of and forming a groove in the surface of the insertion end, said grooving tool comprises a lever having a first end and a second end, said groove forming surface located on the first end, said pivot axis located between the first and second ends of said lever and said means for pivoting said grooving tool located adjacent the second end of said lever, a plurality of said grooving tools are spaced equiangularly apart around the axis of said insertion end and said means for pivoting said grooving tools arranged for simultaneously pivoting each of said grooving tools, and said groove forming surfaces having a plurality of serially arranged faces disposed angularly to one another for forming stop faces in the base of the grooves.

6. Apparatus, as set forth in claim 5, wherein said means for pivoting said grooving tool comprises a power cylinder displaceable in the direction in the axis of said insertion end and a member connecting said power cylinder to said lever.

* * * * *